United States Patent [19]

De Vault et al.

[11] 4,059,535

[45] Nov. 22, 1977

[54] ASHLESS DETERGENT ADDITIVES FOR FUELS AND LUBRICANTS

[75] Inventors: Albert N. De Vault; Hans D. Holtz, both of Bartlesville, Okla.

[73] Assignee: Phillips Petroleum Company, Bartlesville, Okla.

[21] Appl. No.: 691,119

[22] Filed: May 28, 1976

[51] Int. Cl.[2] ..... C10M 1/40; C10M 3/34; C10M 5/22; C10M 7/38

[52] U.S. Cl. ..... 252/33; 44/66; 44/58

[58] Field of Search ..... 260/401; 252/34, 47.5, 252/33; 44/72, 66, 71

[56] References Cited

U.S. PATENT DOCUMENTS

| | | | |
|---|---|---|---|
| 2,183,516 | 12/1939 | Mink | 260/401 |
| 2,329,086 | 9/1943 | Robinson et al. | 260/401 |
| 2,822,335 | 2/1958 | Stayner | 260/401 |
| 3,238,257 | 3/1966 | Ballard et al. | 44/72 |
| 3,287,267 | 11/1966 | Yonezaki | 252/47.5 |
| 3,438,898 | 4/1969 | Schlobolm et al. | 260/401 |

*Primary Examiner*—Daniel E. Wyman
*Assistant Examiner*—Mrs. Y. Harris-Smith

[57] ABSTRACT

A long chain monocarboxylic acid is reacted with a multi-amine to produce an amide and the amide is then treated with sulfonic acid to produce a sulfonate to provide compounds which are suitable as ashless detergent additives and the method for producing these compounds are provided. In a preferred embodiment the detergent additives are combined with hydrocarbons suitable as fuel in an internal combustion engine and with oil formulations to provide ashless fuel detergent compositions and lubricant detergent compositions.

12 Claims, No Drawings

ASHLESS DETERGENT ADDITIVES FOR FUELS AND LUBRICANTS

BACKGROUND OF THE INVENTION

This invention relates to additives for hydrocarbons suitable for use in an internal combustion engine. In one of its aspects this invention relates to detergent additives for hydrocarbon fuels. In another of its aspects this invention relates to detergent additives for hydrocarbon lubricants. In another of its aspects this invention relates to ashless fuel detergent additives for use in hydrocarbon fuel in internal combustion engines. In yet another aspect of the invention it relates to compounds containing a plurality of different functional moieties combining to produce superior ashless fuel detergent qualities and superior detergent lubricants.

With the advent of pollution standards for automobile exhausts it has become important that fuel additives not contain metal ions which tend to poison the catalyst in automotive engine exhaust converter systems. It is well known that amide, sulfonate, and amine functional groups can provide engine protection as fuel and lubricant additives. Up until now, however, additive packages have been made up of mixtures of several different compounds such as amides formed by the reaction of dicarboxylic acid with alkylene polyamines, amine salts of sulfonic acids or reaction products of a polyamine and a petroleum sulfonic acid. In this invention multiple detergent functionalities are combined into a single molecule by combining amide, sulfonate, and amine functionalities together with long hydrocarbon chains which enhance solubility in fuels and lubricants.

It is therefore an object of this invention to provide multiple detergent functionalities for internal combustion engine fuels and lubricants in a single molecule. It is another object of this invention to provide a method for producing detergent additives comrising multiple functionalities in a single molecule. It is still another object of this invention to provide an ashless detergent fuel composition combining an ahsless fuel detergent additive with a hydrocarbon suitable for use as fuel in an internal combustion engine.

Other aspects, objects and the various advantages of this invention will become apparent upon reading the specification and the appended claims.

STATEMENT OF THE INVENTION

A method for producing detergent additive for ashless fuels and lubricants combining multiple detergent functionalities in a single molecule is provided by (1) reacting a long chain monocarboxylic acid with a multi-amine to produce an amide and (2) further reacting the amide produced with sulfonic acid to produce a sulfonated product.

A compound suitable as a detergent additive for lubricants and ashless fuels is provided which is a compound prepared by reacting a sulfonic acid with the product obtained from the reaction of a long chain monocarboxylic acid and a multi-amine with the product containing at least one equivalent of both carboxylic acid and sulfonic acid in each molecule of the final product.

A composition suitable as an ashless, detergent fuel for internal combustion engines or a detergent lubricant is also provided by combining an effective amount of the detergent additive of this invention with a hydrocarbon or hydrocarbon mixture suitable for use as fuel in an internal combustion engine or suitable for use as a lubricant. An aspect of this embodiment of the invention can also be stated as a method for reducing engine deposits in internal combustion engines by adding to a hydrocarbon fuel other compounds prepared by this invention in an amount effective as an ashless fuel detergent.

The additives of this invention are produced by reacting sequentially a multi-amine (polyamine) with a long chain monocarboxylic acid to form an amide. This product, which need not be recovered from the reaction mixture, is then treated with a sulfonic acid or mixture of sulfonic acids to form a sulfonated product.

The amine starting materials have at least 2 amine groups per molecule, preferably 3 or more. They may be represented by generic formulas I: $N(RNH_2)_3$ where R is an aliphatic radical having 1–6 carbon atoms. Typical compounds are: tris-methylamino amine, tris-(2-aminoethyl) amine, tris-(4-amino-2-methylbutyl) amine, (2-aminoethyl-bis-3-aminopropyl) amine and the like;

II: $NH_2(CH_2CH_2NH)_xH$ where $x$ is an integer of 1–100, preferably 3–10. Typical compounds are ethylene diamine, tetraethylenepentamine, triethylenetetramine, hexaethyleneheptamine, nonaethylenedecamine, and the like. Mixtures of I, II, or I and II may be used.

The monocarboxylic acids which may be used comprise a large number of acids having the general formula R'COOH in which R' is a long chain aliphatic radical having 10–30 carbon atoms, either straight chain or branched. Mixtures of these acids commonly available from commercial sources may also be used. Representative acids are neodecanoic acid, stearic acid, oleic acid, dodecanoic acid, isostearic acid (a mixture of branched acids having 16–18 carbon atoms), eicosic acid, phenyl stearic acid, tall oil acids, acid mixtures derived from the saponification of fats and oils such as cottonseed oil, saffron oil, peanut oil, and the like.

The sulfonic acids useful for this invention are broadly represented by the generic formula $R''SO_3H$ where R'' is aliphatic, cycloaliphatic, alkaryl having 12–30 carbon atoms in the molecule. Mixtures of sulfonic acids as produced by the sulfonation of white oils and other petroleum fractions commonly known as petroleum sulfonic acids or "mahogany" acid can be used. The preferred average molecular weight range of these acid mixtures is between 200–1000. Representative acids are dodecylbenzene sulfonic acid, octadecylsulfonic acid, eicosylsulfonic acid, stearyl sulfonic acid, oleyl sulfonic acid, heptadecylbenzene sulfonic acid, etc.

The initial reaction of the amine and monobasic acid is carried out using a conventional stirred apparatus with a solvent selected from xylenes or petroleum naphtha at a temperature in the range of 300°–350° F (150°–177° C), preferably at reflux temperature, for a period of 6–8 hours. At least one equivalent of the monobasic acid is used. Preferably two or more of the primary or secondary amine groups present in the molecule are reacted initially. In the case of the amines represented by $N(RNH_2)_3$ at least two and preferably all three primary amine groups are reacted with the monocarboxylic acid.

The product of the first reaction is then reacted with the sulfonic acid to form a sulfonate. Since this is the reaction of a strong acid with a strong base, contact of the reactants results in reaction. At least one residual amine group is treated to incorporate at least one equivalent of the sulfonic acid in the molecule. When using $N(RNH_2)_3$ compounds, with all three primary amine groups having been reacted with the aliphatic monobasic acid, the sulfonic acid treatment forms a quaternary salt of the general formula

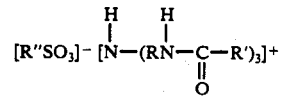

where R, R', R'' are as previously defined.

The final product is a detergent additive which is used at about 1-100 lb./1000 barrels of fuel to prevent harmful carburetor and intake system deposits. The fuel can be any hydrocarbon useful as an internal combustion engine fuel, preferably hydrocarbon mixtures used in commercial fuel blends.

The additives of this invention also are found to be useful with lubricant stocks, particularly solvent refined, paraffinic lubricant stock having a viscosity index of 100 or above and a Saybolt Viscosity at 210° F in the range of about 39 to about 100 SUS, preferably about 45 to about 75 SUS. Other additives commonly used in formulating lubricants, such as Viscosity Index improvers, antioxidants, and the like can be used in formulation with the additives of this invention without destroying the effectiveness of the additives.

PREPARATION OF THE ADDITIVES

EXAMPLE I 28.4 g (0.1 mole) stearic acid and 14.6 ml. (0.1 mole) triethylene-tetramine were dissolved in 250 ml. xylene in a stirred reactor equipped with a reflux condenser. The reactor was heated to reflux temperature (150°-180° C) and the water was continuously removed and collected. The reaction was continued until water evolution ceased.

To the above mixture, 30 g (0.09 mole) dodecylbenzene sulfonic acid was added and the mixture was heated to the boiling point of xylene which was distilled from the reactor. After 50 ml. xylene had been distilled the heating was stopped and the mixture was allowed to cool. After filtering a small quantity of floc, the filtrate was concentrated by "Rotavapor" (a thin film evaporator apparatus) to give an amber viscous liquid. Nitrogen content was 5.67 wt. %. In this example, 1 equivalent of monocarboxylic acid was used.

EXAMPLE II 28.4 g (0.1 mole) stearic acid
28.4 g (0.1 nominal mole) isostearic acid
18.9 ml (0.1 mole) tetraethylenepentamine
200 ml. xylene The above ingredients were reacted as in Example I and then 32.6 g (0.1 mole) dodecylbenzene sulfonic acid was added as in Example I. In this example, two equivalents of monocarboxylic acid were used.

EXAMPLE III 56.8 g (0.2 mole) stearic acid
28.4 g (0.1 mole, nominal) isostearic acid
18.9 ml. (0.1 mole) tetraethylenepentamine
32.6 g (0.1 mole) dodecylbenzene sulfonic acid The above quantities of reagents were reacted as in Example I. In this example, 3 equivalents of two different monocarboxylic acids were used.

EXAMPLE IV 17 g tris (2-aminoethyl)amine 0.116 mole
100 g isostearic acid (nominal 0.35 mole)
100 ml. xylene The ingredients were placed in a flask equipped as in Example I and heated to reflux temperature. After the theoretical amount of water had been collected, xylene was stripped off and the solid amide recovered. 50 g of the amide was then reacted with 15.5 g dodecylbenzene sulfonic acid. The product was a clear, very viscous liquid containing 2.3 wt. % sulfur and 4.45 wt. % nitrogen.

EXAMPLE V 14.6 g (0.1 mole) tris(2-aminoethyl)amine
51.6 g (0.3 mole) neodecanoic acid
30 ml. xylene These ingredients were refluxed until 4.8 ml. $H_2O$ had been collected. The residual mixture was then treated with 0-32 g (0.1 mole) dodecylbenzene sulfonic acid in 100 ml. toluene. After distillation of the solvent the derived product was recovered. Analysis of the product: 4.8 wt. % nitrogen, 3.1 wt. % sulfur.

EXAMPLE VI 14.6 g (0.1 mole) tris(2-aminoethyl)amine
34.4 g (0.2 mole) neodecanoic acid
100 ml. xylene The above named ingredients were refluxed at 440° F. 28.4 g stearic acid (0.1 mole) was added and the refluxing continued until evolution of water ceased. 25 g dodecylbenzene sulfonic acid was added. The solvent was stripped and product of the following analysis was recovered: N=5.73 wt. %; S=2.76 wt. %.

EXAMPLE VII 16.2 g neodecanoic acid (0.094 mole)
33.8 g of an alkylate of benzene and oleic acid (.094 mole)
8.9 g tetraethylenepentamine (0.047 mole)

The ingredients were dissolved in 100 ml. xylene and refluxed at 400° F until 3.4 ml. water had been collected. The product had an analysis of $N_2$ = 5.0%. To 20 g (0.017 mole) of the above product was added 4.2 g (0.017 mole) dodecylbenzene sulfonic acid. After the reaction was complete, the solvent was stripped and the sulfonated product was recovered. (Analysis: $N_2$ = 4.2%, S = 1.8%).

All of the samples prepared in Examples I-VII were subjected to a "Falcon Carburetor" test in which the additive was added to the hydrocarbon fuel in the amount of 10 lbs. of additive per 1000 barrels of hydrocarbon fuel. In the "Falcon Carburetor" test a premium base unleaded gasoline without additive as a control and with various additives for test purposes was used to power a 170 CID 6-cyclinder Falcon engine. The engine was run for 23 hours at 1800 rpm and 11.4 vhp with continuous, non-cyclic operation. About 0.5 cubic feet per minute ambient air was introduced through PCV valve below the carburetor and 3.2 cubic feet per minute of exhaust gas was recirculated unfiltered through the carburetor throttle bore. Intake air was filtered through the standard filter element. An SAE 10W-40 motor oil was used as with the oil sump temperature maintained at 216 plus −4° F. The temperature of coolant out was maintained at 196 plus −5° F and the intake air temperature was varied to control the temperature above the carburetor sleeve at 150 plus −2° F. The fuel flow as maintained at about 1.5 gallons per hour with the air/fuel ratio checked periodically but not controlled and the intake manifold vacuum recorded but not controlled.

The performance of a fuel or additive in this test was evaluated on the basis of deposits formed on a removable aluminum sleeve in the carburetor throat. Three or four differential weights were obtained between the weight of the sleeve at the start of the test and the weights after the test: (1) unwashed, and (2) n-heptane washed. Visual ratings of deposits were not used in the evaluation. The results of the evaluation of the control and test runs are tabulated below.

| Run No. | Additive Identification | mg deposit unwashed | heptane washed mg deposit | % improvement over unwashed deposit |
|---|---|---|---|---|
| 1 (control) | no additive | 23.4 | 13.1–21.1 | 0 |
| 2 | Example I | 6.7 | 5.3 | 71 |
| 3 | Example II | 5.3 | 4.0 | 77 |
| 4 | Example III | 4.5 | 2.8 | 81 |
| 5 | Example IV | 5.5 | 4.1 | 77 |
| 6 | Example V | 9.0 | 7.6 | 61 |
| 7 | Example VI | 4.4 | 3.1 | 81 |
| 8 | Example VII | 8.8 | 7.9 | 62 |

The tests demonstrate the effectiveness of the samples in reducing carburetor and intake system deposits. Although, because of the spread of data obtained for the control in the washed deposit, only the unwashed deposit data is tabulated for percent improvement over the control, it is obvious that taking even the worst case which is Example VII with the washed deposit showing 7.9 mg and the control showing 13.1 mg deposit that an improvement of 40 percent is evident. The single molecule multi-functional additive compounds of this invention are, therefore, effective detergent additives for hydrocarbon fuels.

EXAMPLE VIII 1283.1 g tall oil acid
246 ml. tetraethylenepentamine
500 ml. xylene The above ingredients were heated in a flask equipped with a DeanStark receiver at reflux until 81 ml. water had been collected. The solvent was distilled at 300° F/3 mm. Hg for about 1 hour. The product was reacted with a 1:1 mixture of dodecylbenzene sulfonic acid and light lubricating oil (KC-10) to make the sulfonated amide. The amide product and the amide sulfonate were tested as additives to an outboard motor oil formulation at a ratio of 50:1 oil:additive. In a test for piston varnish in which a rating of 10 signifies a clean sample, the amide product rated 4 and the amide sulfonate rated 7.1.

EXAMPLE IX

Similarly, amides were first formed from isostearic acid and tetraethylenepentamine and the sulfonate formed using sulfonic acid oil (Phil-Ad)* in KC-10 stock. The piston varnish rating for the sulfonate was 8.9 and no plug fouling was observed in the 30 hour test.

*A Phillips Petroleum Company Trademark

EXAMPLE X

As in Example I, isostearic acid and tetraethylenepentamine were reacted to form the amide which was then treated with a 50—50 mixture by weight of dodecylbenzenesulfonic acid and KC-10 stock. Piston varnish rating for the sulfonate was 9.5 and no plug fouling (30 hour test).

The procedure for the Outboard Motor Oil test used above was: a 1975 Johnson Outboard Motor, HP-25 equipped with a test prop was suspended in a water reservoir. The motor was run at 4800–4900 rpm., wide open, for 55 minutes and then was idled for 5 minutes. The cycles were continued for 30 or 50 hours. The motor was examined for spark plug fouling, piston varnish, and other possibly detrimental effects. The amount of lubricant composition in the fuel was that recommended for the test motor.

The data from Examples VIII, IX, and X show that the compositions are effective in preventing spark plug fouling and in maintaining engine cleanliness.

We claim:

1. A method for producing detergent additive for lubricants and fuels comprising:

1. reacting a long chain monocarboxylic acid having the general formula R'COOH in which R' is a long chain aliphatic radical having 10–30 carbon atoms with a multi-amine represented by the generic formula $N(RNH_2)_3$ wherein R is an aliphatic radical having 1–6 carbon atoms to produce an amide and
2. further reacting the product of (1) with sulfonic acid represented by the formula $R''SO_3H$ where R'' is aliphatic, cycloaliphatic, or alkaryl having 12–30 carbon atoms in the molecule to produce a sulfonated product.

2. A method of claim 1 wherein said monocarboxylic acid and said multi-amine are reacted at a temperature within the range of about 300° F to about 350° F in the presence of a solvent selected from xylenes or petroleum naphtha.

3. A detergent additive for lubricants and fuels produced by the method of claim 1.

4. A detergent additive for lubricants and fuels produced by the method of claim 2.

5. A compound useful as a detergent additive for lubricants and fuels prepared by reacting with a sulfonic acid represented by the formula $R''SO_3H$ where R'' is aliphatic, cycloaliphatic, or alkaryl having 12–30 carbon atoms in the molecule the product of the reaction of a long chain monocarboxylic acid having the general formula R'COOH in which R' is a long chain aliphatic radical having 10–30 carbon atoms and a multi-amine represented by the generic formula $N(RNH_2)_3$ wherein R is an aliphatic radical having 1–6 carbon atoms.

6. A composition comprising a hydrocarbon suitable as fuel in an internal combustion engine and a compound of claim 5, said compound of claim 6 present in an amount effective as an ashless fuel detergent additive.

7. A composition comprising a lubricating oil and a compound of claim 5, said compound of claim 6 present in an amount effective as a lubricating oil additive.

8. A method for reducing engine deposits in an internal combustion engine comprising the addition of a detergent fuel additive of claim 5 to the hydrocarbon fuel for the engine, said ashless fuel detergent being added in an amount effective to reduce engine deposits and using said hydrocarbon fuel with ashless fuel detergent additive as fuel in an internal combustion engine.

9. A composition of claim 6 wherein said ashless fuel detergent is present in the range of about 1 to about 100 lb./1000 barrels of fuel.

10. A method of claim 8 wherein said ashless fuel detergent is present in the range of about 1 to about 100 lb./1000 barrels of fuel.

11. A method of claim 1 wherein the long chain monocarboxylic acid is chosen from stearic acid and neodecanoic acid, said multi-amine is tris(2-aminoethyl) amine, and said sulfonic acid is dodecylbenzene sulfonic acid.

12. A compound of claim 5 wherein the long chain monocarboxylic acid is chosen from stearic acid and neodecanoic acid, said multi-amine is tris(2-aminoethyl) amine, and said sulfonic acid is dodecylbenzene sulfonic acid.

* * * * *